US007676886B2

(12) United States Patent
Kim

(10) Patent No.: US 7,676,886 B2
(45) Date of Patent: Mar. 16, 2010

(54) CARPET CLEANER WITH PRESSED-DOWN SUCTION

(76) Inventor: Sam Kim, 1180 Kasting Ln., Mundelein, IL (US) 60060

( * ) Notice: Subject to any disclaimer, the term of this patent is extended or adjusted under 35 U.S.C. 154(b) by 0 days.

(21) Appl. No.: 12/191,820

(22) Filed: Aug. 14, 2008

(65) Prior Publication Data

US 2009/0013495 A1 Jan. 15, 2009

Related U.S. Application Data

(62) Division of application No. 11/447,776, filed on Jun. 6, 2006, now Pat. No. 7,571,513.

(51) Int. Cl.
*A47L 9/00* (2006.01)
*A47L 7/00* (2006.01)

(52) U.S. Cl. ..... 15/410; 15/320; 15/361; 15/362

(58) Field of Classification Search ..... 15/320, 15/322, 361, 362, 410; *A47L 7/00, 9/00*
See application file for complete search history.

(56) References Cited

U.S. PATENT DOCUMENTS 6,779,229 B2 * 8/2004 Lee et al. ..... 15/329
2006/0156509 A1 * 7/2006 Luebbering et al. ..... 15/410

* cited by examiner

*Primary Examiner*—David A Redding
(74) *Attorney, Agent, or Firm*—John K. Park; Park Law Firm

(57) ABSTRACT

A carpet cleaner with a base, a handle, and a plurality of wheels is provided. The carpet cleaner includes a suction opening provided at a front portion of the base of the carpet cleaner and a detachable pressing bar extended from the front portion of the base above the suction opening, wherein the suction opening is pressed down to the carpet floor by pushing down the detachable pressing bar, wherein the suction opening contacts the carpet floor tight for facilitating suction of the carpet cleaner. The detachable pressing bar includes a built-in spring for regulating the amount of pressure to the detachable pressing bar. The pressing bar includes a handle adapted to grab and push.

2 Claims, 4 Drawing Sheets

CARPET CLEANER WITH PRESSED-DOWN SUCTION

CROSS REFERENCE TO RELATED APPLICATION

This application is a divisional application based on patent application Ser. No. 11/447,776 filed on Jun. 6, 2006 now U.S. Pat. No. 7,571,513.

BACKGROUND OF THE INVENTION

The present invention relates to a carpet cleaner with pressed-down suction.

Carpets have a long history, but more often than not, its maintenance has been a problem for a long time.

Unlike a smooth surface made of tile, linoleum, and parquet floor, the carpet floor tends to catch dirt and other debris.

Although vacuum cleaners can effectively pick up debris, it cannot clean the carpet. Household-use carpet cleaners made in response to this problem are still ineffective because the power of the carpet cleaner may not be strong enough or the stain is too stubborn.

In such circumstances, it might be helpful to lower the suction opening of the vacuum cleaner. Some of the vacuum cleaners have such a function to control the gap between the suction opening and the floor, but the lowering of the suction opening is very limited, and there has been no way to solve the problem satisfactorily.

Accordingly, a need for a carpet cleaner has been present for a long time. This invention is directed to solve these problems and satisfy the long-felt need.

SUMMARY OF THE INVENTION

The present invention contrives to solve the disadvantages of the prior art.

An object of the invention is to provide a carpet cleaner with a pressed-down suction that will lend more power for stain removal.

Another object of the invention is to provide a carpet cleaner that facilitate sucking in of dirt by pressing down the suction opening.

Still another object of the invention is to provide a carpet cleaner with a pressing bar for facilitating the suction of dirt.

A carpet cleaner with a base, a handle and a hand lever connected to a fulcrum in the base via a cable line to enable the pressed-down function of the base containing the suction opening.

The hand lever is located directly below the handle and when pulled, activates the cable line.

The cable line, which runs behind the body of the carpet cleaner pulls on an extension of the base.

The base and its extension acts as a lever, using the wheel axle as a fulcrum to raise the extension of the base.

The suction opening that is provided at the front portion of the base is then pressed-down into the carpet surface by the pulling of the hand lever.

Another possible modification of the above invention can be one where only the suction opening is pressed-down into the carpet floor as opposed to the whole base being tilted and pressed-down.

In this modification, the suction opening still located in the frontal part of the base will be attached to a frame encircling the outside of the existing base, which will act as a lever.

The process remains the same as the pressed-down frontal base carpet cleaner but the only difference would be that instead of the entire carpet cleaner base being tilted; only the frame encircling the base would be tilted to bring the suction opening closer to the carpet surface.

The present invention is briefly summarized, but fuller understanding of the invention can be obtained by the following drawings, detailed description and appended claims.

Another addition to the carpet cleaner may include a pressing bar.

The detachable pressing bar is attached to the front portion of the base above the suction opening, as needed.

The suction opening is pressed onto the carpet floor by pushing down with the pressing bar. Consequently, the suction opening makes tight contact with the carpet floor conducive to deeper and definite cleaning.

The detachable pressing bar has a built in spring which will regulate the amount of pressure put onto the pressing bar. The spring will act as a shock absorbent in the case that too much pressure is put on the pressing bar. If too much pressure is put on the bar, it will push the base of the carpet cleaner down too far therefore making it hard to navigate the carpet cleaner.

More specifically, the carpet cleaner with a base, a handle, and a plurality of wheels includes a suction opening, a fulcrum, and a cable line.

The suction opening is provided at a front portion of the base of the carpet cleaner.

The fulcrum is provided at a rear portion of the base of the carpet cleaner.

The cable line is extended from the rear portion of the lever toward the handle.

The suction opening is pressed down to the carpet floor by the lever actuated by pulling up the cable line, and the suction opening contacts the carpet floor tight for facilitating suction of the carpet cleaner.

The suction opening is fixed to the base of the carpet cleaner. The base forms a lever about the fulcrum, and the base of the carpet cleaner is tilted as a whole when the cable line is pulled up.

The suction opening is oblong, and the suction opening is perpendicular to the moving direction of the carpet cleaner.

The fulcrum is vertically aligned with the handle and the wheels.

The lever is integrated with the base of the carpet cleaner, the fulcrum is integrated with the base, and the fulcrum is defined by the position of the handle.

The lever may further include a rear bar of a predetermined length extended from the rear side of the base. The cable line is fixed to the end of the rear bar.

The carpet cleaner may further include a plurality of guide rings provided along the rear side of the handle, and the cable line is queued through the guide rings.

The carpet cleaner may further include a hand lever, fixed to the handle and connected to the spring, for pulling the cable line. The hand lever is disposed directly below the handle.

The base further includes a wheel axle, and the wheel axle works as the fulcrum.

The suction opening is adapted to be partially extractable, and the suction opening is adapted to press down the carpet floor when the suction opening is extracted.

The carpet cleaner further includes a lever with an active end and a passive end. The lever includes two front legs, a rear fork, and a rear bar. Two front legs, fixed to the suction opening, are for forming the passive end of the lever. The rear fork is for connecting to the two front legs and forming the active end of the lever. The rear bar is extended from the rear fork.

The two front legs and the rear fork encircle the rear and side portions of the base.

The fulcrum includes a rotatable axle provided through the base and fixed to the two legs of the lever at the fulcrum point.

The rotatable axle is integrated with the lever, and the rotatable axle works as a wheel axle.

The suction opening is partially extracted and presses down the carpet floor when the cable line is pulled up, and only the lever, formed by the suction opening, two front legs, and the rear fork, is tilted.

The fulcrum further includes two fulcrum caps for covering and fixing the connection between the lever and the rotatable axle.

Another carpet cleaner may include a suction opening and a detachable pressing bar.

The suction opening is provided at a front portion of the base of the carpet cleaner.

The detachable pressing bar is extended from the front portion of the base above the suction opening.

The suction opening is pressed down to the carpet floor by pushing down the detachable pressing bar, wherein the suction opening contacts the carpet floor tight for facilitating suction of the carpet cleaner.

The detachable pressing bar includes a built-in spring for regulating the amount of pressure to the detachable pressing bar. The pressing bar includes a handle adapted to grab and push.

The carpet cleaner may further include one of more rear wheels provided under the base.

The advantages of the present invention are: (1) the carpet cleaner is able to clean the carpet floor more effectively; and (2) the suction opening is pressed down by a lever or a pressing bar.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
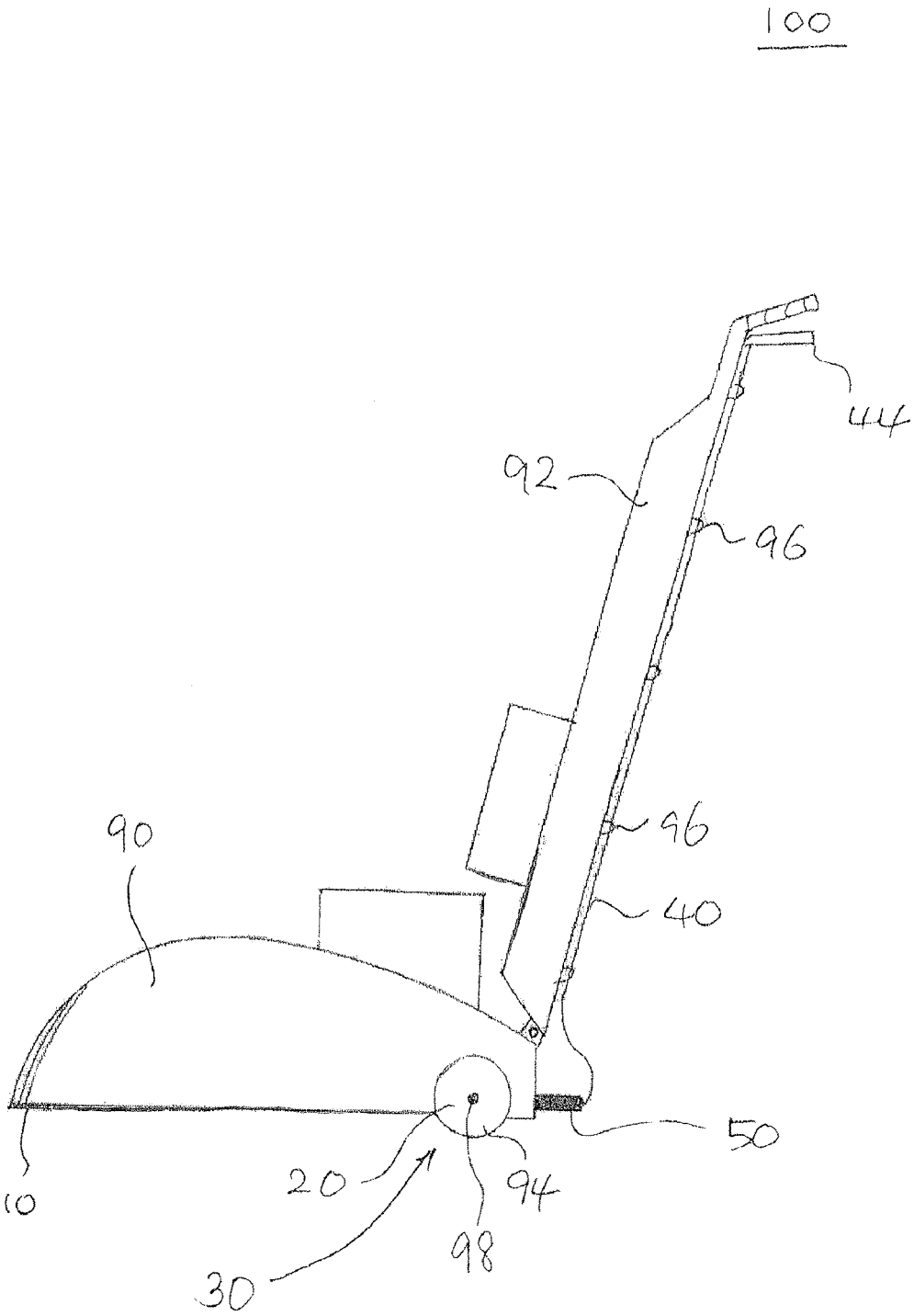
FIG. 1 is a side plan view showing a carpet cleaner with a first embodiment of lever according to the invention.

FIG. 1 shows a side plan view of a carpet cleaner 100 with a first embodiment of a lever according to the invention.

The carpet cleaner 100 with a base 90, a handle 92, and a plurality of wheels 94 includes a suction opening 10, a fulcrum 20, a lever 30, and a cable line 40.

The suction opening 10 is provided at a front portion of the base 90 of the carpet cleaner 100.

The fulcrum 20 is provided at a rear portion of the base 90 of the carpet cleaner 100.

The cable line 40 is extended from the rear portion of the lever toward the handle.

The suction opening 10 is pressed down to the carpet floor by pulling up the cable line 40, and the suction opening 10 contacts the carpet floor tight for facilitating suction of the carpet cleaner 100.

The suction opening 10 is fixed to the base 90 of the carpet cleaner 100. The base forms a lever 30 about the fulcrum 20, and the base 90 of the carpet cleaner 100 is tilted as a whole when the cable line 40 is pulled up.

The suction opening 10 is oblong, and the suction opening 10 is perpendicular to the moving direction of the carpet cleaner 100.

The fulcrum 20 is vertically aligned with the handle 92 and the wheels 94.

The lever 30 is integrated with the base 90 of the carpet cleaner 100, the fulcrum 20 is integrated with the base 90, and the fulcrum 20 is defined by the position of the handle 92.

The lever 30 may further include a rear bar 50 of a predetermined length extended from the rear side of the base 90. The cable line 40 is fixed to the end of the rear bar 50 as shown in FIG. 1.

The carpet cleaner 100 may further include a plurality of guide rings 96 provided along the rear side of the handle 92, and the cable line 40 is queued through the guide rings 96.

The carpet cleaner 100 may further include a hand lever 44, fixed to the handle 92 and connected to the cable line 40, for pulling the cable line 40. The hand lever 44 is disposed directly below the handle 92.

The cable line 40 controls the pressing-down force from the suction opening 10 through the hand lever 44.

The base 90 may further include a wheel axle 98, and the wheel axle 98 works as the fulcrum 20.

Figure 2:
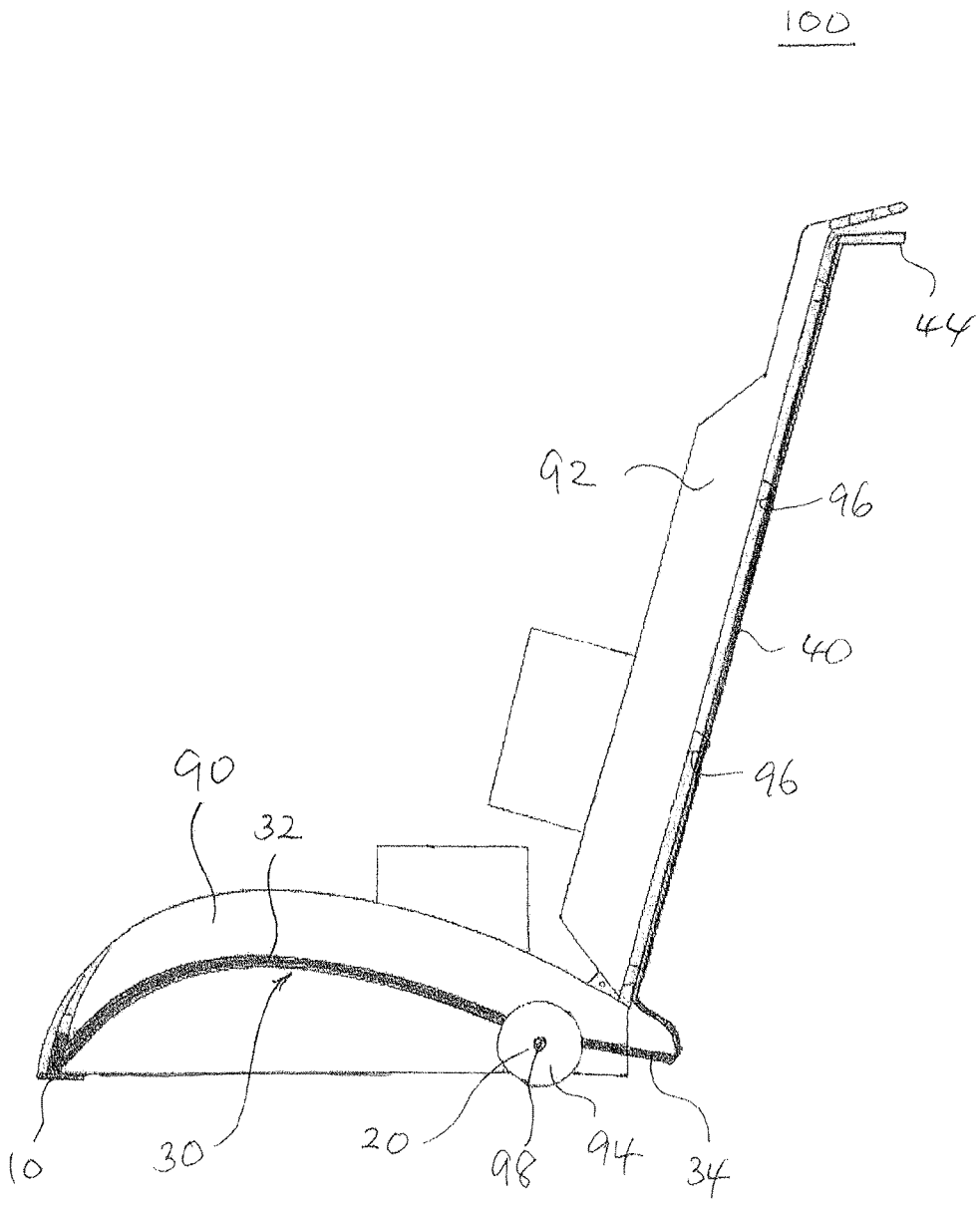
FIG. 2 is a side plan view of a carpet cleaner with a second embodiment of lever.
Figure 3:
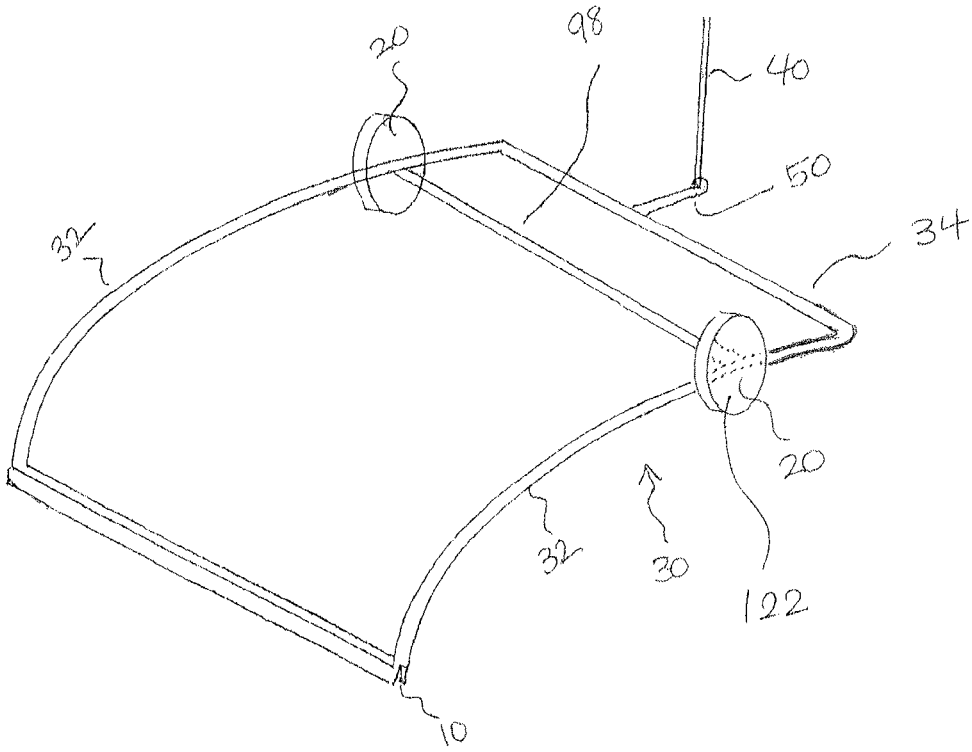
FIG. 3 is a perspective view showing the lever of FIG. 2.

In the second embodiment as shown in FIG. 2 and FIG. 3, the suction opening 10 is adapted to be partially extractable, and the suction opening 10 is adapted to press down the carpet floor when the suction opening 10 extracted.

The carpet cleaner 100 further includes a lever 30, and the lever 30 includes two front legs 32, a rear fork 34, and a rear bar 50 as shown in FIG. 2 and FIG. 3. Two front legs 32, fixed to the suction opening 10, are for forming the passive end of the lever 30. The two front legs 32 and the rear fork 34 encircle the rear and side portions of the base 90.

The rear fork 34 is for connecting to the two front legs 32 for forming the active end of the lever 30. The rotatable axle 98 works as a wheel axle.

The rear bar 50 is extended from the rear fork 34.

The fulcrum 20 includes a rotatable axle 98 provided through the base 90 and fixed to the two legs 32 of the lever 30 at the fulcrum point.

The rotatable axle 98 is integrated with the lever 30.

The suction opening 10 is partially extracted and presses down the carpet floor when the cable line 40 is pulled up. Only the lever 30, formed by the suction opening 10, two front legs 32, and the rear fork 34, is tilted.

The fulcrum 20 further includes two fulcrum caps 122 for covering and fixing the connection between the lever 30 and the rotatable axle 98 as shown in FIG. 3.

Figure 4:
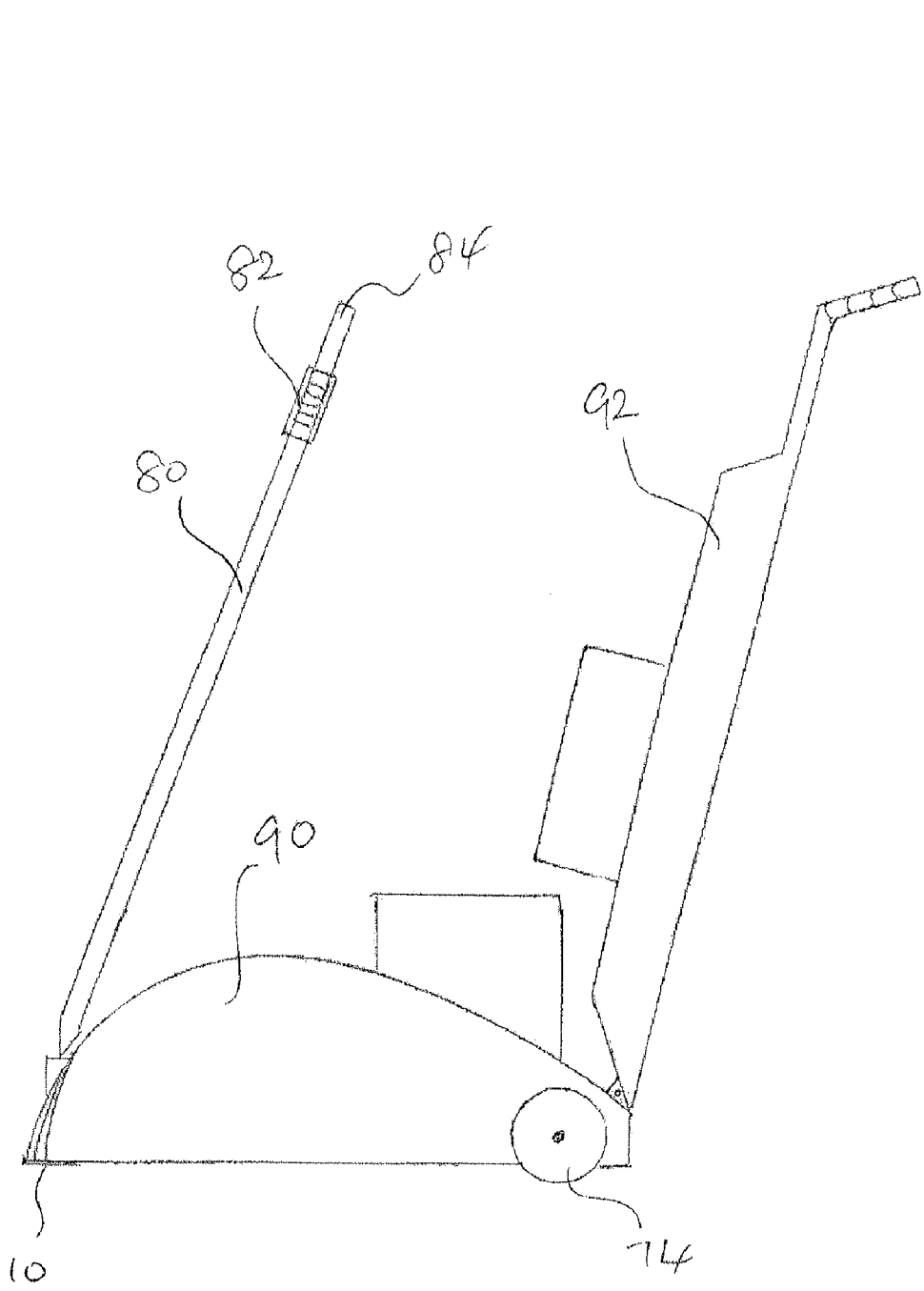
FIG. 4 is a side plan view of a carpet cleaner with a detachable pressing bar.

Alternatively, as shown in FIG. 4, the carpet cleaner 100 may include a suction opening 10 and a detachable pressing bar 80.

The suction opening 10 is provided at a front portion of the base 90 of the carpet cleaner 100.

The detachable pressing bar 80 is extended from the front portion of the base 90 above the suction opening 10.

The suction opening 10 is pressed down to the carpet floor by pushing down the detachable pressing bar 80, and the suction opening 10 contacts the carpet floor tight for facilitating suction of the carpet cleaner 100.

The detachable pressing bar 80 includes a built-in spring 82 for regulating the amount of pressure to the detachable pressing bar 80.

The pressing bar 80 includes a handle 84 adapted to grab and push.

The carpet cleaner 100 may further include one of more rear wheels 74 provided under the base 90.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A carpet cleaner with a base, a handle, and a plurality of wheels comprising:

a) a suction opening provided at a front portion of the base of the carpet cleaner; and b) a detachable pressing bar extended from the front portion of the base above the suction opening, wherein the suction opening is pressed down to the carpet floor by pushing down the detachable pressing bar, wherein the suction opening contacts the carpet floor tight for facilitating suction of the carpet cleaner, wherein the detachable pressing bar comprises a built-in spring for regulating the amount of pressure to the detachable pressing bar.

2. The carpet cleaner of claim 1, wherein the pressing bar comprises a handle adapted to grab and push.

* * * * *